US006835928B2

(12) United States Patent
Bateman

(10) Patent No.: US 6,835,928 B2
(45) Date of Patent: Dec. 28, 2004

(54) MASS SPECTROMETER

(75) Inventor: Robert Harold Bateman, Knutsford (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/654,483

(22) Filed: Sep. 4, 2003

(65) Prior Publication Data

US 2004/0094709 A1 May 20, 2004

Related U.S. Application Data

(60) Provisional application No. 60/427,560, filed on Nov. 20, 2002.

(30) Foreign Application Priority Data

Sep. 4, 2002 (GB) ..... 0220571

(51) Int. Cl.[7] ..... H01J 4/42

(52) U.S. Cl. ..... 250/282; 250/281; 250/287; 250/288; 250/292

(58) Field of Search ..... 250/292, 288, 250/282, 281, 287

(56) References Cited

U.S. PATENT DOCUMENTS 4,945,236 A 7/1990 Mogami et al.
4,985,626 A 1/1991 Margulies
5,521,382 A * 5/1996 Tanaka et al. ..... 250/292
5,852,302 A 12/1998 Hiraishi et al.
6,194,717 B1 * 2/2001 Hager ..... 250/292
6,504,148 B1 * 1/2003 Hager ..... 250/282
6,700,120 B2 * 3/2004 Hager ..... 250/292
6,703,607 B2 * 3/2004 Stott et al. ..... 250/282
2004/0011956 A1 * 1/2004 Londry et al. ..... 250/292

FOREIGN PATENT DOCUMENTS

JP 2002015699 6/2000

* cited by examiner

*Primary Examiner*—Nikita Wells
*Assistant Examiner*—Johnnie L Smith, II
(74) *Attorney, Agent, or Firm*—Diederiks & Whitelaw PLC

(57) ABSTRACT

A mass spectrometer is disclosed comprising a multi-mode quadrupole rod set. In a first mode of operation, the quadrupole rod set is operated as a mass filter to selectively transmit ions having desired mass to charge ratios to an ion detector. In a second mode of operation, the quadrupole rod set operates as a drift or time of flight region in which ions which have been pulsed into the drift or time of flight region become temporally separated according to their mass to charge ratios. In the second mode of operation, the ion detector determines the time of flight of ions passing through the quadrupole rod set.

103 Claims, 7 Drawing Sheets

MASS SPECTROMETER

CROSS-REFERENCE TO RELATED APPLICATIONS

The present application claims the benefit of the filing U.S. Provisional Patent Application Ser. No. 60/427,560 filed on Nov. 20, 2002.

BACKGROUND OF THE INVENTION

1. Field of the Invention

The present invention relates to a mass spectrometer and a method of mass spectrometry.

2. Discussion of the Prior Art

Quadrupole rod sets are known which comprise two pairs of parallel rods. Each pair of diametrically opposed rods are electrically connected to each other and to the same phase of an RF voltage supply. The RF voltage supply is arranged such that the RF voltage applied to one pair of diametrically opposed rods has a 180° phase difference with respect to the other pair of rods.

The quadrupole rod set can be operated as a mass filter to transmit ions having specific mass to charge ratios and to attenuate other ions by maintaining a DC potential difference between adjacent pairs of rods. When a DC potential difference is maintained between the pairs of rods certain ions will remain stable in the quadrupole rod set and will be transmitted from one end of the quadrupole rod set to the other. However, other ions will become unstable and hence will not be transmitted by the quadrupole rod set. The DC potential difference maintained between the rods may be arranged, for example, such that ions with mass to charge ratios outside of a narrow range are destabilised and are not transmitted. The DC potential difference can also be increased or scanned so that eventually only ions having a specific mass to charge ratio will be stable in the quadrupole rod set whilst other ions have been filtered out. A further increase in the DC voltage may result in all of the ions being destabilised such that no ions are transmitted. Accordingly, appropriate selection of the RF and DC voltages applied to the quadrupole rod set allows ions of only selected mass to charge ratios to be transmitted whilst all other ions are discarded.

The quadrupole rod set mass filter efficiently transmits ions having a specific mass to charge ratio. However, when ions having a range of mass to charge ratios are required to be recorded the RF and DC voltages applied to the quadrupole rod set must be scanned so as to successively transmit ions of one mass to charge ratio at a time. This results in the duty cycle for transmitting ions of any specific mass to charge ratio decreasing as the range of mass to charge ratios to be recorded increases. For example, if the mass range to be scanned is 500 mass units and the mass peak width at base is one mass unit, then the time spent transmitting ions having the same mass to charge ratio to within one mass to charge ratio unit is 1/1000 of the total scan time and hence the duty cycle drops to 0.1%. This is to be compared with a duty cycle of 100% when the quadrupole rod set mass filter is used to transmit ions having a single mass to charge ratio.

A further limitation of using a quadrupole rod set mass filter/mass analyser to record ions having a range of mass to charge ratios is the time taken to acquire a complete mass spectrum. Ions transmitted through a quadrupole mass filter typically have a relatively low energy, e.g. only a few eV. Therefore, the ions tend to take a relatively long period of time to travel the length of the quadrupole rod set. The length of time is dependent upon the length of the quadrupole rod set and the energy of the ions. The quadrupole rod set mass filter cannot therefore be scanned at a rate faster than the time taken for ions to travel the length of the quadrupole rod set otherwise the ions will not be allowed adequate time to be transmitted. For examples the ions may require between 0.1 ms and 1 ms to travel the length of the quadrupole rod set. Therefore, the quadrupole rod set mass filter cannot be scanned much faster than 1 ms per mass unit otherwise ions will no longer have adequate time to be transmitted. Accordingly, the minimum time required to scan 500 mass units is typically between 0.1 and 0.5 seconds.

It is apparent from the above considerations that the quadrupole rod set mass filter is suited to applications in which it is only required to record and quantify ions having a single or limited range of mass to charge ratios. A quadrupole rod set mass filter is not particularly suited to applications where it is required to record ions having a relatively wide range of mass to charge ratios with high sensitivity and at relatively high speed.

A Time of Flight mass analyser is another known mass analyser. A Time of Flight mass analyser comprises a drift or flight region and a fast ion detector. Ions entering the drift or flight region are arranged to have a constant energy and therefore separate as they travel through the drift or flight region according to their mass to charge ratio. A fast Analogue to Digital Converter ("ADC") or a Time to Digital Converter ("TDC") may be used to record the arrival times of the ions at the ion detector. The arrival times enable the mass to charge ratios of the ions to be calculated since the mass to charge of an ion is proportional to the square of the flight time of the ion from the entrance of the drift region to the ion detector.

A Time of Flight mass spectrometer may record a full mass spectrum for each pulse of ions leaving the ion source. If the ion source is a pulsed ion source, such as a Laser Ablation or a Matrix Assisted Laser Desorption and Ionisation ("MALDI") ion source, then the duty cycle for recording the full mass spectrum can be 100%. If the ion source is continuous, such as an Electrospray or Electron Impact ion source, then the duty cycle is determined by the means by which the continuous beam of ions is sampled and packets of ions are injected into the drift or flight region of the Time of Flight mass analyser.

Orthogonal acceleration Time of Flight mass spectrometers typically achieve a sampling duty cycle in the range of 5–25%. The combination of a non-mass selective ion trap used in conjunction with an orthogonal acceleration Time of Flight mass spectrometer may increase the duty cycle to around 100% for ions having a specific narrow range of mass to charge ratios, whilst the duty cycle for ions outside of that range of mass to charge ratios will fall to 0%.

A Time of Flight mass spectrometer is not ideal for recording ions having a narrow range of mass to charge ratios e.g. ions having a range of only one or two mass to charge ratio units. The duty cycle and transmission of a Time of Flight mass spectrometer required to record ions having a narrow spread of only one or two mass to charge ratio units does not match that of a quadrupole rod set mass filter in a comparable situation. Furthermore, the linear dynamic range of the ion detection systems typically used in a conventional Time of Flight mass spectrometer is inferior to that used in a mass spectrometer incorporating a quadrupole rod set mass analyser. This is due to the fact that ions are recorded in very short bursts in a Time of Flight mass spectrometer whereas ions are recorded continuously in a mass spectrometer incorporating a quadrupole mass analyser.

Although Time of Flight mass spectrometers are suited to applications where it is required to acquire a full mass spectrum quickly and with high sensitivity, Time of Flight mass spectrometers are not particularly suited to applications where it is required to record and quantify ions having mass to charge ratios which differ by a few mass to charge ratio units.

SUMMARY OF THE INVENTION

It is desired to provide an improved mass spectrometer.

According to an aspect of the present invention there is provided a mass spectrometer comprising:

a multi-mode quadrupole rod set; and an ion detector;

wherein in a first mode of operation the quadrupole rod set acts as a mass filter and wherein in a second mode of operation the quadrupole rod set forms a time of flight region of a Time of Flight mass analyser.

In the first mode of operation ions having mass to charge ratios within a first range are preferably transmitted by the quadrupole rod set and ions having mass to charge ratios outside of the first range are preferably substantially attenuated by the quadrupole rod set. AC or RF voltages are applied to the rods of the quadrupole rod set and a DC potential difference is maintained between adjacent rods when the quadrupole rod set is in the first mode of operation.

In the second mode of operation ions are pulsed into the time of flight region. Ions are transmitted through the quadrupole rod set without being substantially mass filtered and become temporally separated according to their mass to charge ratio. The ion detector determines the time of flight of the ions through the time of flight region. AC or RF voltages are applied to the rods of the quadrupole rod set and all the rods of the quadrupole rod set are maintained at substantially the same DC potential in the second mode of operation.

In the first and/or the second mode of operation the quadrupole rod set is preferably maintained at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

In the first and/or the second mode of operation the quadrupole rod set is preferably maintained at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

In the first and/or the second mode of operation the quadrupole rod set is preferably maintained at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

The mass spectrometer preferably further comprises a collision cell and a further quadrupole rod set arranged upstream of the collision cell. The multi-mode quadrupole rod set is preferably arranged downstream of the collision cell.

In a MS mode of operation the further quadrupole rod set acts as a mass filter to mass filter parent ions. Parent ions are collisionally cooled within the collision cell, and parent ions preferably exit the collision cell in a substantially non-pulsed manner. The multi-mode quadrupole rod set is preferably operated in a third mode of operation so as to transmit parent ions without substantially mass filtering the parent ions.

In a MS/MS mode of operation the further quadrupole rod set acts as a mass filter to mass filter parent ions. At least 10%, 20%, 30%, 40%, 50%, 60%, 70%, 80%, 90%, 95% or 100% of parent ions entering or within the collision cell are preferably fragmented upon entering or within the collision cell to form fragment ions. Fragment ions are collisionally cooled within the collision cell, and preferably exit the collision cell in a substantially non-pulsed manner. The multi-mode quadrupole rod set is operated in the first mode of operation so as to mass filter fragment ions. The multi-mode quadrupole rod set may be scanned so as to act as a mass analyser.

In a MS-TOF mode of operation the further quadrupole rod set acts as an ion guide to transmit parent ions without substantially mass filtering the parent ions. The parent ions are collisionally cooled and/or trapped within the collision cell and may be pulsed out of the collision cell. The multi-mode quadrupole rod set is preferably operated in the second mode of operation so that parent ions become temporally separated as they pass through the time of flight region formed by the multi-mode quadrupole rod set.

In a MS/MS-TOF mode of operation the further quadrupole rod set acts as a mass filter to mass filter parent ions. At least 10%, 20%, 30%, 40%, 50%, 60%, 70%, 80%, 90%, 95% or 100% of parent ions entering or within the collision cell are preferably fragmented upon entering or within the collision cell to form fragment ions. The fragment ions are collisionally cooled and/or trapped within the collision cell and are preferably pulsed out of the collision cell. The multi-mode quadrupole rod set is operated in the second mode of operation so that fragment ions become temporally separated as they pass through the time of flight region formed by the multi-mode quadrupole rod set.

The collision cell may comprise a segmented rod set or a stacked ring set comprising a plurality of electrodes having apertures wherein ions are transmitted, in use, through the apertures.

An axial DC voltage gradient may be maintained in use along at least a portion of the length of the collision cell. In a mode of operation an axial DC voltage difference is maintained, in use, along at least a first portion of the collision cell and is selected from the group consisting of: (i) 0.1–50 V; (ii) 50–100 V; (iii) 100–200 V; (iv) 200–500 V; (v) 500–1000 V; (vi) 1000–2000 V; (vii) 2000–3000 V; (viii) 3000–4000 V; (ix) 4000–5000 V; (x) 5000–6000 V; (xi) 6000–7000 V; (xii) 7000–8000 V; (xiii) 8000–9000 V; (xiv) 9000–10000 V; and (xv) >10 kV. In a mode of operation an axial DC voltage gradient is maintained, in use, along at least a first portion of the collision cell selected from the group consisting of: (i) 0.1–5 V/mm; (ii) 5–10 V/mm; (iii) 10–20 V/mm; (iv) 20–30 V/mm; (v) 30–40 V/mm; (vi) 40–50 V/mm; (vii) 50–60 V/mm; (viii) 60–70 V/mm; (ix) 70–80 V/mm; (x) 80–90 V/mm; (xi) 90–100 V/mm; (xii) 100–150 V/mm; (xiii) 150–200 V/mm; (xiv) 200–250 V/mm; (xv) 250–300 V/mm; (xvi) 300–350 V/mm; (xvii) 350–400 V/mm; (xviii) 400–450 V/mm; (xix) 450–500 V/mm; and (xx) >500 V/mm. The first portion is preferably located within a region located 0–10%, 10–20%, 20–30%, 30–40%, 40–50%, 50–60%, 60–70%, 70–80%, 80–90%, or 90–100% of the length of the collision cell measured from an ion entrance of the collision cell to an ion exit of the collision cell. The first portion may preferably be located in the rearmost 10%, 20%, 30%, 40% or 50% of the collision cell.

The collision cell preferably consists of 10–20 electrodes, 20–30 electrodes, 30–40 electrodes, 40–50 electrodes, 50–60 electrodes, 60–70 electrodes, 70–80 electrodes, 80–90 electrodes, 90–100 electrodes, 100–110 electrodes, 110–120 electrodes, 120–130 electrodes, 130–140 electrodes, 140–150 electrodes or >150 electrodes.

The collision cell is preferably maintained, in use, at a pressure selected from the group consisting of: (i) $>1.0\times10^{-3}$ mbar; (ii) $>5.0\times10^{-3}$ mbar; (iii) $>1.0\times10^{-2}$ mbar; (iv) $10^{-3}$–$10^{-2}$ mbar; and (v) $10^{-4}$–$10^{-1}$ mbar.

In a mode of operation ions are trapped but are not substantially fragmented within the collision cell. In another mode of operation ions are trapped and are substantially fragmented within the collision cell. In a further mode of operation ions are trapped within the collision cell and are progressively moved towards an exit of the collision cell. Ions may be stored or trapped within the collision cell near the exit of the collision cell. In a mode of operation ions are collisionally cooled within the collision cell in an ion trapping region located near the exit of the collision cell.

According to a preferred embodiment electrodes forming the collision cell may be maintained at different DC potentials so that at least a first and a second different stage axial acceleration electric field region are provided to accelerate ions out of the collision cell. Prior to accelerating ions out of the collision cell the pressure within the collision cell may be reduced. The ratio of the axial electric field strength in the second stage axial acceleration electric field region to the axial electric field strength in the first stage axial acceleration electric field region is preferably ≧2, ≧3, ≧4, ≧5, ≧6, ≧7, ≧8, ≧9 or ≧10. A ratio of approximately 8 is particularly preferred.

The collision cell may further comprise one or more grid electrodes arranged between electrodes forming the collision cell, wherein one or more DC voltages are applied to the one or more grid electrodes in order to provide the first and/or the second stage axial acceleration electric field regions.

One or more transient DC voltages or one or more transient DC voltage waveforms may be initially provided at a first axial position and may then subsequently provided at second, then third different axial positions along the collision cell.

One or more transient DC voltages or one or more transient DC voltage waveforms may move from one end of the collision cell to another end of the collision cell so that ions are urged along the collision cell. The one or tore transient DC voltages may create a potential hill or barrier, a potential well, multiple potential hills or barriers, multiple potential wells, a combination of a potential hill or barrier and a potential well, or a combination of multiple potential hills or barriers and multiple potential wells. The one or more transient DC voltage waveforms preferably comprise a repeating waveform such as a square wave.

According to a less preferred embodiment the collision cell may comprise a quadrupole rod set. However, such an arrangement does not easily facilitate the provision of axial electric fields.

The mass spectrometer preferably further comprises an AC or RF ion guide arranged upstream of the further quadrupole rod set. The AC or RF ion guide preferably comprises a plurality of electrodes. Additionally or alternatively, the sass spectrometer may comprise an AC or RF ion guide arranged upstream of the multi-mode quadrupole rod set wherein the AC or RF ion guide comprises a plurality of electrodes. The AC or RF ion guide may comprise a quadrupole, hexapole, octapole or higher order multipole rod set. Alternatively, the AC or RF ion guide may comprise a segmented rod set. More preferably, the AC or RF ion guide may comprise an ion tunnel ion guide comprising a plurality of electrodes having apertures through which ions are transmitted.

The AC or RF ion guide is preferably supplied with an AC or RF voltage having a frequency selected from the group consisting of; (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

The AC or RF ion guide is preferably supplied with an AC or RF voltage having an amplitude selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

In a mode of operation parent ions may be arranged to be trapped, stored or otherwise accumulated in the AC or RF ion guide whilst other ions are being collisionally cooled and/or fragmented in the collision cell and/or whilst ions are being transmitted through the multi-mode quadrupole ion trap operating in the second mode of operation. In one mode of operation ions are pulsed out of the AC or RF ion guide.

One or more transient DC potentials or one or more DC potential waveforms may be applied to the electrodes of the AC or RF ion guide. The one or more transient DC potentials or the one or more DC potential waveforms preferably urge ions from one region of the AC or RF ion guide to another region of the AC or RF ion guide.

According to a less preferred embodiment an ion trap may be arranged between the collision cell and the multi-mode quadrupole rod set. A further drift or time of flight region may also be arranged downstream of the multi-mode quadrupole rod set. A reflectron may additionally/alternatively be arranged downstream of the multi-mode quadrupole rod set.

According to another aspect of the present invention there is provided a method of mass spectrometry comprising:

providing a multi-mode quadrupole rod set and an ion detector;

operating the quadrupole rod set in a first mode of operation wherein the quadrupole rod set acts as a mass filter; and operating the quadrupole rod set in a second mode of operation wherein the quadrupole rod set forms a time of flight region of a Time of Flight mass analyser.

According to another aspect of the present invention there is provided a mass spectrometer comprising a first multi-mode AC or RF ion guide wherein in a first mode of operation the first AC or RF ion guide acts as an ion guide and wherein in a second mode of operation the first AC or RF ion guide forms a time of flight region.

In the first mode of operation ions are preferably transmitted through the first AC or RF ion guide without being substantially mass filtered. Ions are preferably not substantially fragmented within the first AC or RF ion guide. Ions are preferably substantially continuously transmitted through the first AC or RF ion guide.

In the second mode of operation ions are pulsed into the time of flight region. Ions are preferably transmitted through the first AC or RF ion guide without being substantially mass filtered and become temporally separated according to their mass to charge ratio.

An ion detector may be provided wherein the ion detector determines the time of flight of the ions through the time of flight region.

A second AC or RF ion guide may be provided, preferably downstream of the first multi-mode AC or RF ion guide, wherein ions transmitted through the first multi-mode AC or RF ion guide are received by the second AC or RF ion guide. The second AC or RF ion guide may comprise a segmented rod set. Alternatively, the second AC or RF ion guide may comprise an ion tunnel ion guide comprising a plurality of electrodes having apertures through which ions are transmitted in use.

In use one or more transient DC voltages or one or more transient DC voltage waveforms are initially provided at a first axial position and are then subsequently provided at second, then third different axial positions along the second AC or RF ion guide.

One or more transient DC voltages or one or more transient DC voltage waveforms may move in use from one end of the second AC or RF ion guide to another end of the second AC or RF ion guide so that ions are urged along the second AC or RF ion guide. The one or more transient DC voltages may create a potential hill or barrier, a potential well, multiple potential hills or barriers, multiple potential wells, a combination of a potential hill or barrier and a potential well, or a combination of multiple potential hills or barriers and multiple potential wells. The one or more transient DC voltage waveforms applied to the second AC or RF ion guide preferably comprise a repeating waveform such as a square wave.

When the first multi-mode AC or RF ion guide is operated in the second mode of operation ions having mass to charge ratios within a first range are preferably trapped in a first axial trapping region within the second AC or RF ion guide and ions having mass to charge ratios within a second different range are preferably trapped in a second different axial trapping region within the second AC or RF ion guide. Ions having mass to charge ratios within a third different range are likewise preferably trapped in a third axial trapping region within the second AC or RF ion guide and ions having mass to charge ratios within a fourth different range are preferably trapped in a fourth different axial trapping region within the second AC or RF ion guide. Similarly, ions having mass to charge ratios within a fifth range are preferably trapped in a fifth axial trapping region within the second AC or RF ion guide and ions having mass to charge ratios within a sixth different range are preferably trapped in a sixth different axial trapping region within the second AC or RF ion guide.

In the first and/or second mode of operation the first AC or RF ion guide is preferably maintained at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar. In the first and/or second mode of operation the first AC or RF ion guide is preferably maintained at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar. In the first and/or second mode of operation the first AC or RF ion guide is preferably maintained at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-5}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

According to another embodiment in the first mode of operation the first AC or RF ion guide may be maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar. In the first mode of operation the first AC or RF ion guide may be maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar. In the first mode of operation the first AC or RF ion guide may be maintained at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

The first AC or RF ion guide may comprise a quadrupole, hexapole, octapole or higher order multipole rod set. Alternatively, the first AC or RF ion guide comprises a segmented rod set. More preferably, the first AC or RF ion guide comprise an ion tunnel ion guide comprising a plurality of electrodes having apertures through which ions are transmitted in use.

In the first mode of operation the first AC or RF ion guide is preferably supplied with an AC or RF voltage having a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

In the second mode of operation the first AC or RF ion guide is preferably supplied with an AC or RF voltage having a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

In the first mode of operation the first AC or RF ion guide is preferably supplied with an AC or RF voltage having an amplitude selected from the group consisting of; (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

In the second mode of operation the first AC or PR ion guide is preferably supplied with an AC or RF voltage having an amplitude selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

The mass spectrometer preferably further comprises an Electrospray ("ESI") ion source, an Atmospheric Pressure Chemical Ionisation ("APCI") ion source, an Atmospheric Pressure Photo Ionisation ("APPI") ion source, a Matrix Assisted Laser Desorption Ionisation ("MALDI") ion source, a Laser Desorption Ionisation ("LDI") ion source, an Inductively Coupled Plasma ("ICP") ion source, an Electron Impact ("EI") ion source, a Chemical Ionisation ("CI") ion source, a Fast Atom Bombardment ("FAB") ion source or a Liquid Secondary Ions Mass Spectrometry ("LSIMS") ion source. The ion source may be pulsed or continuous.

According to another aspect of the present invention there is provided a method of mass spectrometry comprising:

providing a multi-mode AC or RF ion guide;

operating the AC or RF ion guide in a first mode of operation wherein the AC or RF ion guide acts as an ion guide; and operating the AC or RF ion guide in a second mode of operation wherein the AC or RF ion guide forms a time of flight region.

According to another aspect of the present invention there is provided a mass spectrometer comprising a collision cell, the collision cell comprising a plurality of electrodes wherein in a mode of operation a first stage axial acceleration electric field region and a second different stage axial field region are provided to accelerate ions out of the collision cell.

The ratio of the axial electric field strength in the second stage axial acceleration electric field region to the electric field strength in the first stage axial acceleration electric field region is selected from the group consisting of: (i) ≧2; (ii) ≧3; (iii) ≧4; (iv) ≧5; (v) ≧6; (vi) ≧7; (vii) ≧8; (viii) ≧9; and (ix) >10. A ratio of about 8 is particularly preferred.

Prior to accelerating ions out of the collision cell the pressure within the collision cell may be reduced.

According to another aspect of the present invention there is provided a method of mass spectrometry comprising:

providing a collision cell comprising a plurality of electrodes;

providing a first stage axial acceleration electric field across a first region of the collision cell; and providing a second different stage axial field across a second different region of the collision cell;

wherein the first and second stage axial fields are provided to accelerate ions out of the collision cell.

In certain embodiments of the present invention the multi-mode quadrupole rod set may receive ions continuously or in pulses. An AC or RF ion guide may be arranged between the ion source and the quadrupole rod set to either transmit ions continuously or to pulse ions into the quadrupole rod set. In one mode of operation the quadrupole rod set is employed as a quadrupole mass filter with the AC or RF ion guide between the ion source and quadrupole rod set arranged to continuously transmit ions. In this mode of operation the quadrupole rod set is operated with both AC/RF and DC voltages being applied to the rods such that ions are radially confined by the AC/RF electric fields and are mass filtered due to a DC potential difference being maintained between the rods. An ion detector preferably continuously records the ion signal.

In another mode of operation the quadrupole rod set is employed as a time of flight or drift region for use in time of flight mass analysis. In this mode of operation the AC or RF ion guide between the ion source and the quadrupole rod set may be arranged to accumulate ions and release them in discrete pulses. The quadrupole rod set is operated with AC/RF voltages applied to the rods such that the ions are radially confined and drift axially in the quadrupole rod set. The rods are all maintained at substantially the same DC potential. An ion detector preferably records both the ion signal intensity and the time taken for ions released from the AC or RF ion guide to arrive at the ion detector.

In the mode of operation wherein the quadrupole rod set provides a time of flight region, the quadrupole rod set may be used as a drift region because the AC/RF electric fields within the rod set only have radial components. The AC/RF fields act to confine the ions radially and do not exert any axial force on the ions. As such, the quadratic radial electric fields do not interfere with the function of the device which is to provide a drift or time of flight region.

AC/RF voltages applied to the quadrupole rod set may give rise to slight fringe electric fields at the entrance and exit of the quadrupole rod set. These fringe fields may be distorted and may contain a non-linear axial electric field component which could cause a small degree of disruption to the drift velocities of the ions travelling into or out of the quadrupole rod set. However, if a pulsed source of ions is arranged in close proximity to the entrance of the quadrupole rod set and the acceleration of the ions into the quadrupole rod set is synchronised with the AC/RF voltage supply to the rods, then it can be arranged for the ions to enter the quadrupole rod set when the AC/RF voltage is passing through zero. Correct synchronisation of ion acceleration into the quadrupole rod set with the AC/RF voltage will help to ensure that the axial component of the fringe field at the entrance to the quadrupole rod set is both constant and has minimal disruption to the ions during ion entry into the quadrupole rod set.

Synchronising the time of exit of the ions from the quadrupole rod set with the time that the applied AC/RF voltage passes through zero is not possible since when the quadrupole rod set acts as a drift or time of flight region the ions separate according to their mass to charge ratios and exit the rod set at substantially different times. However, the ion detector may be arranged in close proximity to the exit of the quadrupole rod set such that any minor distortion caused by the axial component of the fringe field will be either minimal or negligible. By arranging the ion detector close to the exit of the quadrupole rod set the distance the ions travel after leaving the quadrupole rod set is small in comparison to the length of the quadrupole rod set itself. As such, the time taken for ions to travel from the quadrupole rod set to the ion detector, and hence the distortion in the ions temporal separation is relatively insignificant. If necessary, any distortion may be yet further reduced by accelerating the ions out of the quadrupole rod set and in to the ion detector.

In the preferred embodiment the mass spectrometer may comprise more than one quadrupole rod set and/or other additional analysers. For example, the mass spectrometer may comprise a collision cell and at least one multi-mode quadrupole rod set which in a first mode operates as a mass filter and in a second mode operates as a drift or time of flight region. In the preferred embodiment the mass spectrometer may comprise an ion source, an AC/RF ion guide, a preferred dual-function or multi-mode quadrupole rod set, a collision cell, a dual-function or multi-mode quadrupole rod set and an ion detector arranged in series. The AC/RF ion guide may comprise a multipole rod set. The preferred multi-mode quadrupole rod set may function as a drift or time of flight region in one mode of operation and as a mass filter in another mode of operation. As such the preferred mass spectrometer is capable of performing all the functions of a conventional triple quadrupole mass spectrometer but advantageously has the capability of recording mass spectra for ions having a wide range of mass to charge ratios and also fragment ion spectra resulting from fragmentation of parent ions with high sensitivity and at a faster rate compared with conventional arrangements.

In the preferred embodiment the AC or RF ion guide between the ion source and preferred quadrupole rod set is preferably segmented so that ions may be accumulated in one region of the AC or RF ion guide and may then be released into a quadrupole rod set as a discrete packet of ions. The AC or RF ion guide may comprise, for example, a segmented rod set or stacked ring set and preferably allows ions to be linearly accelerated for subsequent mass analysis downstream when the mass spectrometer is operated in a time of flight mode.

BRIEF DESCRIPTION OF THE DRAWINGS

Various embodiments of the present invention will now be described, by way of example only, and with reference to the following drawings in which.

DETAILED DESCRIPTION OF THE PREFERRED EMBODIMENTS

Figure 1A:
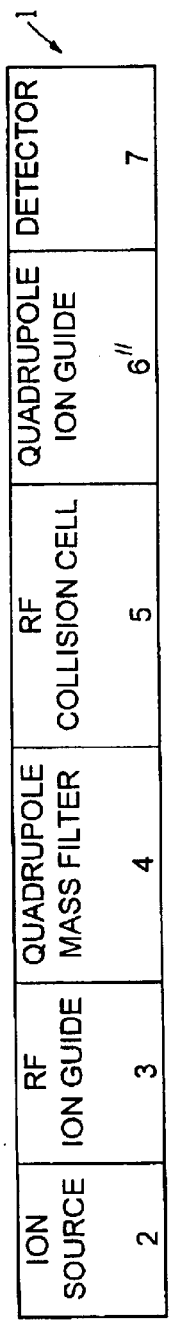
FIG. 1A illustrates a preferred mass spectrometer operating in a MS mode of operation.

A preferred embodiment of the present invention will now be described with reference to FIGS. 1A–1D. The mass spectrometer 1 preferably comprises at least one multi-mode quadrupole rod set 6,6',6" which in one mode of operation functions as (or provides or forms) a drift or flight region for use in time of flight mass analysis and which in another mode of operation functions or acts as a quadrupole mass filter. FIGS. 1A–1D show the components of a preferred triple quadrupole mass spectrometer 1 used in various different modes of operation.

The mass spectrometer 1 preferably comprises an ion source 2, an AC or RF ion guide 3, a first quadrupole rod set 4,4' which may, for example, be operated in either a mass filtering mode of operation or an ion guide (RF only) mode of operation, an RF collision cell 5,5', a multi-mode quadrupole rod set 6,6' according to the preferred embodiment which may be operated in either an ion guide, mass filtering or time of flight mode of operation and an ion detector 7. The AC or RF ion guide 3 may comprise, for example, a quadrupole rod set or an ion tunnel ion guide comprising a plurality of electrodes having substantially similar sized apertures through which ions are transmitted in use.

FIG. 1A shows the preferred mass spectrometer 1 when used in a MS mode. Ions from the ion source 2 enter or are received by the AC or RF ion guide 3 and are transmitted to the first quadrupole rod set 4 which is operated as a mass filter. The first quadrupole rod set 4 has RF potentials applied to the rods of the quadrupole rod set 4 and a DC potential difference is maintained between adjacent rods so that the ions passing through the first quadrupole rod set 4 are mass filtered. Accordingly, only ions having certain desired mass to charge ratios are onwardly transmitted by the first quadrupole rod set 4 to the RF collision cell 5 which is arranged downstream of the first quadrupole rod set 4. A collision gas at a pressure of, for example, $>10^{-3}$ mbar is preferably present or is introduced within the collision cell 5. Parent ions having a particular mass to charge ratio are arranged to enter the collision cell 5 with sufficiently low energies and pass through the collision cell 5 such that the ions are collisionally cooled within the collision cell 5 without substantially being fragmented. The parent ions are then passed from the collision cell 5 to the preferred multi-mode quadrupole rod set 6" which is operated in a RF-only (i.e. ion guide) mode such that the quadrupole rod set 6" acts as an RF ion guide and radially confines ions within the ion guide 6". The ions pass through the quadrupole ion guide 6" and are then detected by the ion detector 7 arranged downstream of the quadrupole rod set 6". In this mode of operation the multi-mode quadrupole rod set 6" neither acts as a mass filter nor as a time of flight region since ions are not mass filtered and neither are they pulsed out of collision cell 5 into the quadrupole rod set 6".

Figure 1B:
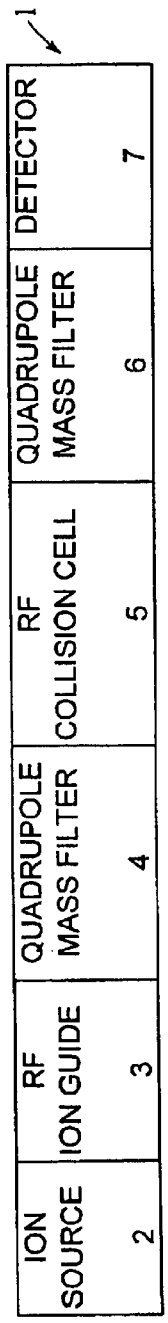
FIG. 1B illustrates a preferred mass spectrometer operating in a MS/MS mode of operation.

FIG. 1B shows the preferred mass spectrometer 1 when used in a MS/MS mode of mass analysis. Ions from the ion source 2 are transmitted through the AC or RF ion guide 3 and pass to the first quadrupole rod set 4 which is operated as a mass filter. Adjacent rods of the first quadrupole rod set 4 are supplied with opposite phases of an AC/RF voltage and a DC potential is maintained between adjacent rods so that the quadrupole rod set 4 acts to filter ions according to their mass to charge ratios. Ions having a specific mass to charge ratio or a specific range of mass to charge ratios are onwardly transmitted by the quadrupole mass filter. 4 to the collision cell 5 whereas other ions are substantially attenuated by the quadrupole mass filter 4. The collision cell 5 is preferably maintained at a DC potential such that ions entering the collision cell 5 are relatively energetic. A gas is provided within the RF collision cell 5 so that at least some of the parent ions entering the RF collision cell 5 are caused to collide with the gas molecules and fragment to produce fragment ions. The fragment ions and any unfragmented parent ions are then passed from the collision cell 5 to the preferred multi-mode quadrupole rod set 6. The multi-mode quadrupole rod set 6 is operated in a mass filtering mode of operation. Accordingly, RF voltages are applied to the rods of the quadrupole rod set 6 and a DC potential difference is maintained between adjacent rods of the quadrupole rod set 6 so that the quadrupole rod set 6 selectively mass filters the fragment ions according to their mass to charge ratio and onwardly transmits selected fragment ions to the ion detector 7.

Figure 1C:
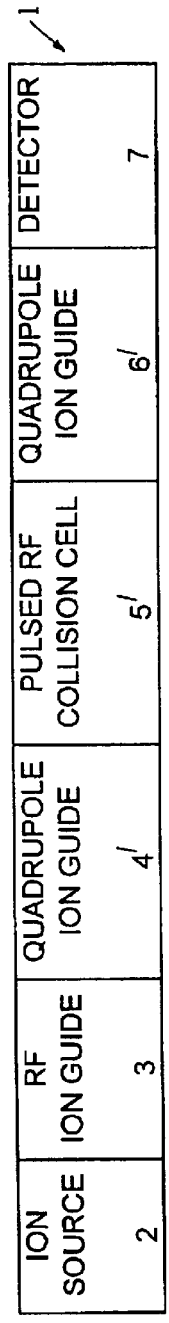
FIG. 1C illustrates a preferred mass spectrometer operating in a MS-TOF mode of operation.

FIG. 1C shows the preferred mass spectrometer 1 when used in a MS-TOF mode of operation. In this mode ions are preferably accumulated in the AC or RF ion guide 3 which is preferably arranged adjacent the ion source 2. The ions are then preferably periodically released out of the AC or RF ion guide 3 and are received by the first quadrupole rod set 4' which is preferably operated in an RF-only or ion guide mode. RF potentials are applied to the rods of the first quadrupole rod set 4' and all the rods are maintained at substantially the same DC potential such that the first quadrupole rod set 4' transmits ions to the collision cell 5' substantially without mass filtering the ions. The ions transmitted through the first quadrupole ion guide 4' are then accumulated or trapped in the collision cell 5' wherein they are collisionally cooled. The ions are then pulsed out of the collision cell 5' and are arranged to enter the second quadrupole rod set 6' which is arranged to operate in a time of flight mode of operation. RF voltages are applied to the rods of the preferred multi-node quadrupole rod set 6' and the rods of the quadrupole rod set 6' are all maintained at substantially the same DC potential so that the quadrupole rod set 6' radially confines the ions but does not substantially mass filter ions passing therethrough. Substantially no axial electric field is provided within the ion guiding region formed within the quadrupole rod set 6' and hence the quadrupole rod set 6' functions as a drift or time of flight region allowing ions which have been pulsed into the quadrupole rod set 6' from the collision cell 5' to temporally separate according to their mass to charge ratios. Preferably, the time at which the ions are pulsed out of the RF collision cell 5' and into the quadrupole rod set 6' is substantially synchronised with the time at which the RF potentials applied to the quadrupole rod set 6' pass through 0 V.

The ions pulsed out of the collision cell 5' separate in time within the quadrupole rod set 6' with ions having relatively low mass to change ratios reaching the end of the time of flight region formed within the quadrupole rod set 6' before ions having relatively high mass to change ratios. The ions exiting the quadrupole rod set 6' then pass to the ion detector 7 which is preferably arranged close to the exit of the quadrupole rod set 6'. The ions may be accelerated from the exit of the quadrupole rod set 6' to the ion detector 7. In the time of flight mode of operation described above ions may preferably be accumulated in the AC or RF ion guide 3 upstream of the first quadrupole rod set 4' whilst previously received ions are either being collisionally cooled within the collision cell 5' and/or are being mass analysed by passing the ions through the time of flight region formed by the quadrupole ion guide 6'.

Figure 1D:
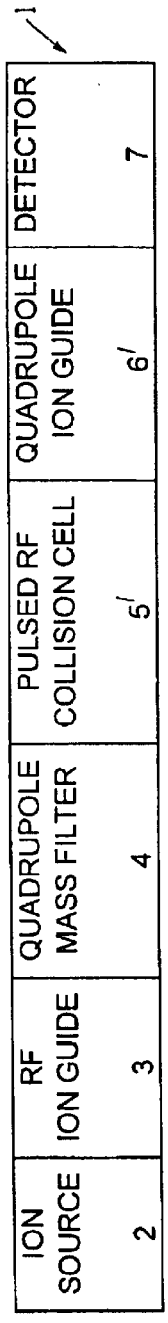
FIG. 1D shows a preferred mass spectrometer operating in a MS/MS-TOF mode of operation.

FIG. 1D shows the preferred mass spectrometer when used in a MS/MS-TOF mode of operation. Parent ions from the ion source 2 are preferably accumulated in the AC or RF ion guide 3 and are then preferably periodically released from or are pulsed out of the AC or RF ion guide 3 and are then transmitted to the first quadrupole rod set 4. The first quadrupole rod set 4 is operated as a mass filter so as to selectively transmit parent ions having a specific mass to charge ratio or parent ions having a specific range of mass to charge ratios. The desired parent ions transmitted by the first quadrupole rod set 4 are then preferably accumulated in the collision cell 5'. The collision cell 5' is preferably maintained at a DC potential such that ions are induced to fragment by a number of relatively high energy collisions with gas molecules present within the collision cell 5'. The fragment ions produced by these collisions are then preferably collisionally cooled within the collision cell 5'. The resulting fragment ions are then preferably pulsed out of the collision cell 5' and pass to the preferred quadrupole rod set 6' which is operated in a time of flight mode and hence forms part of a Time of Flight mass analyser in conjunction with the ion detector 7. Parent ions may continue to be accumulated in the AC or RF ion guide 3 adjacent the ion source 2 whilst other parent ions which have been previously released from the AC or RF ion guide 3 are either fragmented and/or cooled in the collision cell 5' and/or whilst fragment ions are being pulsed out of the collision cell 5' and are being mass analysed by the Time of Flight mass analyser formed by the preferred multi-mode quadrupole rod set 6' and the ion detector 7.

In another embodiment the resolution of the mass spectrometer when operated in a time of flight mode may be further improved by extending the overall ion flight path by providing further drift or flight regions in addition to the preferred multi-mode quadrupole rod set 6'. These further drift or flight regions may be provided, for example, downstream of the multi-mode quadrupole rod set 6'. Additionally/alternatively, a reflectron may be provided through which the ions may travel after leaving the drift or time of flight region formed within the multi-mode quadrupole rod set 6'. The use of a reflectron has the beneficial effect of helping to maintain temporal focusing of the ions.

The performance of the multi-mode quadrupole rod set 6' in conjunction with the ion detector 7 as a Time of Flight mass analyser depends upon the energy spread of the ions which are pulsed out of the collision cell 5' and which are preferably accelerated into the drift or time of flight region provided within the multi-mode quadrupole rod set 6'. It is preferable to minimize the energy spread of the ions by cooling the ions in the collision cell 5' before the ions are pulsed out of the collision cell 5' and into the drift or time of flight region. The ions are preferably allowed to undergo many collisions with a buffer gas in the collision cell 5' such that they are cooled to substantially the same temperature as the buffer gas. For example, if the buffer gas is maintained at ambient temperature then the ions will be cooled to an average energy of about 0.03 eV. The temperature of the buffer gas may be reduced further and hence it is possible that the collisions may cool the ions to an even lower average energy and hence reduce the energy spread of the ions even further.

FIGS. 2A–2F show the structure of the collision cell 5,5' and the potential profile along the collision cell 5,5' according to a preferred embodiment during various stages of ion accumulation, collisional cooling, fragmentation and release. The collision cell 5,5' preferably contains a gas at a pressure in the range $10^{-3}$–$10^{-2}$ mbar so that many ion-gas molecule collisions take place as ions 8 pass through the collision cell 5,5'.

Figure 2A:
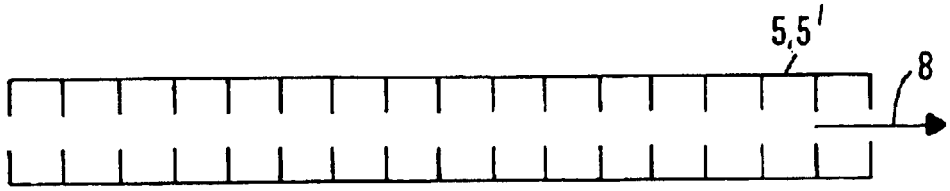
FIG. 2A shows a schematic of the cross section through a preferred collision cell.
Figure 2B:
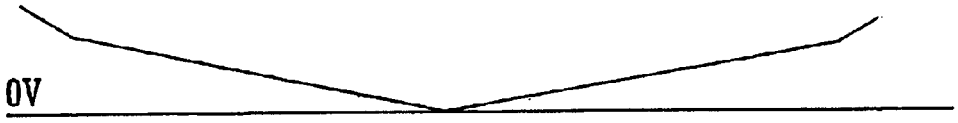
FIG. 2B shows the potential profile along the collision cell in an ion accumulation without fragmentation mode.

FIG. 2A shows a cross section through a preferred collision cell 5,5' which preferably comprises a ring stack collision cell 5,5' comprising a plurality of electrodes having apertures through which ions are transmitted. FIG. 2B shows the potential profile along the collision cell 5,5' when the collision cell 5,5' is used to accumulate ions 8 without substantially fragmenting them. The stacked rings of the collision cell 5,5' are preferably maintained at potentials such that the ions 8 are trapped in a relatively shallow potential well preferably within a central region of the collision cell 5,5'. The embodiment shown in FIG. 2B may be used, for example, to trap parent ions within the collision cell 5' prior to pulsing the parent ions into the preferred quadrupole rod set 6' in the MS-TOF mode of operation described above in relation to FIG. 1C.

Figure 2C:
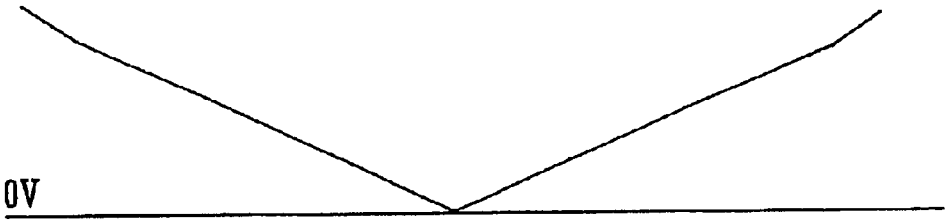
FIG. 2C shows the potential profile along the collision cell in an ion accumulation and fragmentation mode.

FIG. 2C shows the potential profile along the preferred collision cell 5,5' in a mode wherein the collision cell 5,5' is used both to accumulate and to fragment ions 8. In this mode the stacked rings or electrodes are preferably maintained at potentials such that ions 8 entering the collision cell 5,5' are accelerated into a region of the collision cell 5,5' by a relatively steep potential well. The voltage gradient across the collision cell 5,5' helps to accelerate the ions 8 to induce high energy collisions with the collision gas. These collisions cause at least some of the parent ions 8 entering the collision cell 5,5' to fragment within the collision cell 5,5'.

Figure 2D:
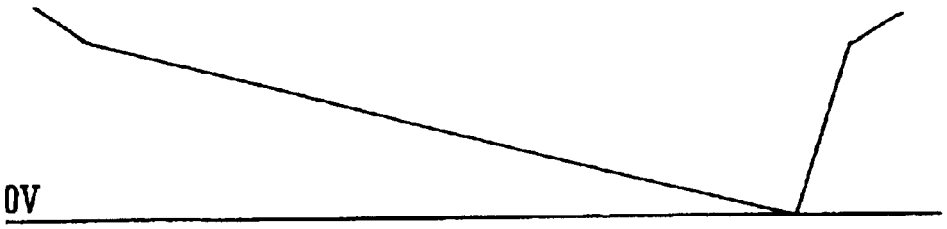
FIG. 2D shows the potential profile along the collision cell at a time when the ions are moved to a region near the exit of the collision cell.

FIG. 2D shows the potential profile along the collision cell 5,5' when ions are moved towards a region near the exit of the collision cell 5,5'. The ions 8 may or may not have been fragmented prior to this stage. The axial DC potentials applied to the electrodes of the collision cell 5,5' may be progressively altered so that the bottom of the potential well is moved progressively closer to the exit of the collision cell 5,5'.

Figure 2E:
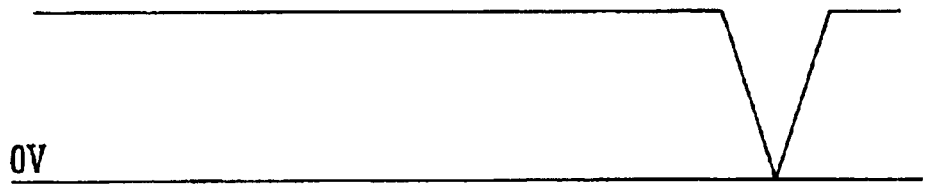
FIG. 2E shows the potential profile along the collision cell at a time when the ions are contained and collisionally cooled in a region near the exit of the collision cell.

FIG. 2E shows the potential profile along the collision cell 5,5' when parent or fragment ions 8 are contained in a region near the exit of the collision cell 5,5' and are collisionally cooled by a buffer gas. The potentials applied to the electrodes are preferably altered so that a relatively narrow and/or steep potential well is provided close to the exit of the collision cell 5,5'. The potentials applied to the electrodes are preferably altered so that the ions 8 do not pick up significant amounts of kinetic energy. Once the ions 8 are confined in the potential well they may then be collisionally cooled by the buffer gas until their range of kinetic energise is sufficiently reduced. Once the ions 8 have been allowed to cool they may then be preferably ejected from the collisional cell 5,5'.

Figure 2F:
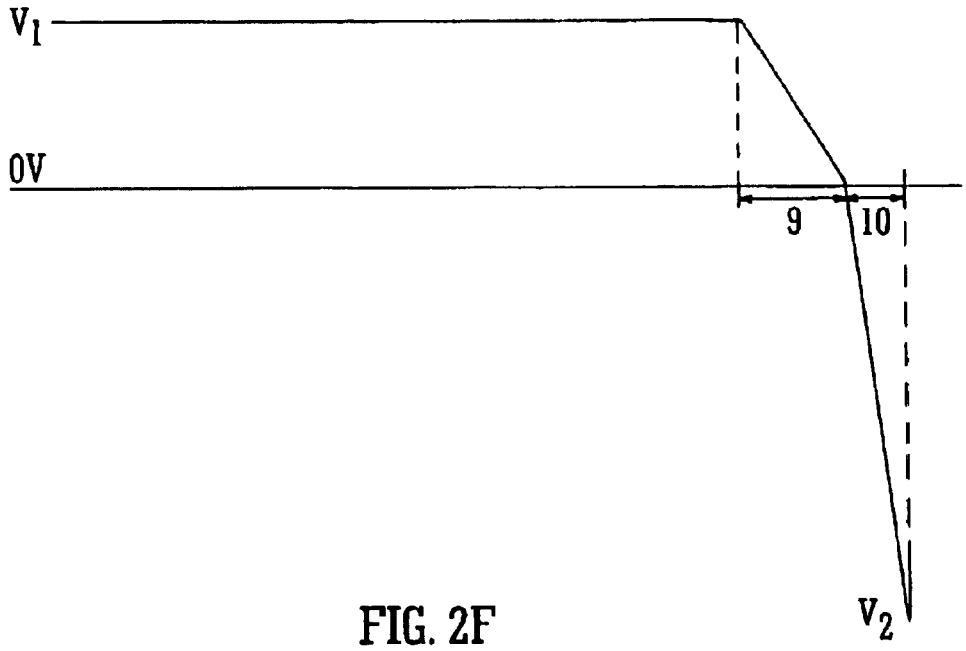
FIG. 2F shows the potential profile along the collision cell at a time when the ions are accelerated or pulsed out of the collision cell.

FIG. 2F shows the potential profile along the collision cell 5' at a time when ions 8 are ejected or pulsed out of the collision cell 5' and into the preferred multi-mode quadrupole rod set 6' which is operated in a time of flight mode of operation. In order to inject the ions 8 into the multi-mode quadrupole rod set 6' the potentials applied to the electrodes of the collision cell 5' at the end of the collision cell 5' are preferably progressively lowered. The exit of the collision cell 5' is preferably maintained at a DC potential equal to or above the DC potential at which the preferred multi-mode quadrupole rod set 6' is held. In a preferred embodiment the pressure of the collision cell 5' is also reduced prior to ions 8 being accelerated or pulsed out of the collision cell 5' and into the preferred multi-mode quadrupole rod set 6'.

In the preferred embodiment a two stage axial accelerating field is used to accelerate ions 8 out of the collision cell 5' and into the preferred multi-mode quadrupole rod set 6'. In order to create a first stage axial accelerating field the potentials applied to the electrodes of the collision cell 5' at a region towards the end of the collision cell 5' are preferably lowered from e.g. a DC potential $V_1>0$ V to e.g. 0 V over a first length 9 of the collision cell 5'. A second stage accelerating field is preferably substantially simultaneously created by preferably lowering the DC potentials of the electrodes in the rearmost portion of the collision cell 5' from $V_1$ to $V_2$, wherein preferably $V_2<0$ V along a second rearmost length 10 of the collision cell 5'.

In one embodiment the length of the multi-mode quadrupole rod set 6' is 250 mm, the first stage accelerating field region 9 has a length of 10 mm and the second stage accelerating field region 10 has a length of 5 mm. Preferably, the potentials $V_1$ and $V_2$ are chosen such that the electric field strength of the second stage 10 is approximately eight times greater than the field strength of the first stage 9, such that a first order spatial and velocity focusing condition as described in more detail below is met. In the preferred embodiment the first stage accelerating field may be established by applying voltages $V_1$ and 0 V to electrodes of the collision cell 5' 15 mm upstream and 5 mm upstream of the exit of the collision cell 5' respectively. The second stage accelerating field may be established by simultaneously applying a voltage $V_2$ to the end electrode of the collision cell 5'.

If $V_1$ is 250 V and $V_2$ is −1000 V then the first stage accelerating field strength will be 25 V/mm and the second stage accelerating field strength will be 200 V/mm. For ions having a mass to charge ratio of 500 and an average energy of 0.03 eV the turn around time as described in more detail below will be approximately 23 ns. The flight time of the ions to the ion detector 7 will be approximately 13.7 $\mu$s and a mass resolution of approximately 300 may be expected.

Alternatively, if $V_1$ is increased to 1000 V and $V_2$ is proportionately increased to −4000 V then the first accelerating field strength will be 100 V/mm and the second accelerating field strength will be 800 V/mm. In this embodiment the turn around time will be reduced from 23 ns to approximately 6 ns. The flight time of ions having a mass to charge ratio of 500 to the ion detector 7 is also reduced to approximately 6.6 $\mu$s and an improved mass resolution of approximately 500 may be expected.

The above embodiment is described in relation to a two-stage accelerating field having well defined boundaries. This may be achieved by using grid electrodes in the preferred stacked ring set collision cell 5,5'. However, this may be less desirable in some circumstances since the grid electrodes may disrupt the operation of the collision cell 5 when it is used in an ion guide mode. In embodiments where grid electrodes are not included in the collision cell 5,5' the axial DC electric fields along the central axis of the collision cell 5' may be weaker and hence less well defined compared with the DC fields between neighbouring electrodes of the collision cell 5'. Larger potentials $V_1$ and $V_2$ may therefore be applied so that the DC field along the central axis is as required.

Ions of the same mass to charge ratio which start from a position close to the exit of the collision cell 5' may reach the ion detector 7 before ions starting further away from the exit of the collision cell 5'. On the other hand, if the ions are accelerated by an electric field it follows that ions nearest the ion detector 7 start from a lower electrical potential difference than those starting from a point further away from the exit of the collision cell 5'. Accordingly, the ions nearest the exit will have gained less energy than those starting further away from the exit by the time they have left the accelerating field and are in the field free region provided within the preferred quadrupole rod set 6'. Hence, ions starting from a point near the exit of the collision cell 5' will have had a head start but will be travelling slower than those ions from a position further away from the exit of the collision cell 5'. The faster ions will therefore catch up and overtake the slower ions that started from a point nearer the exit. The point at which the faster ions just catch up with the slower ions is the position of first order spatial focusing.

Figure 3A:
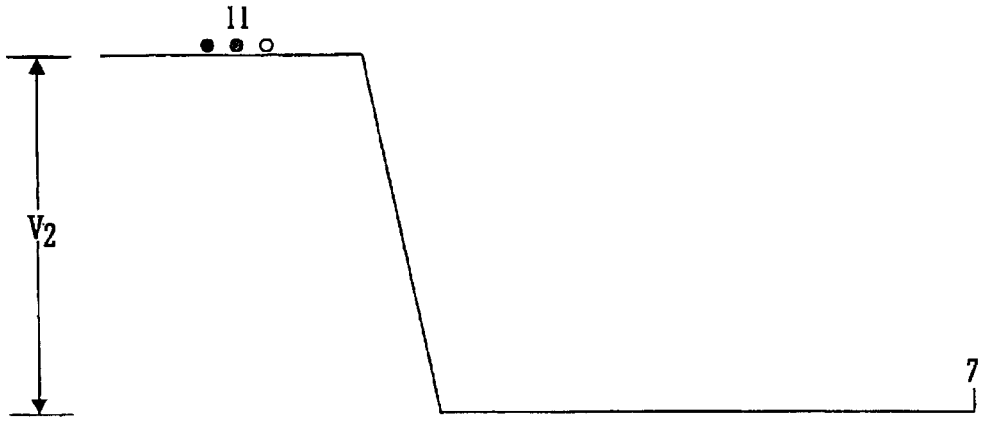
FIG. 3A shows ions having different starting positions in the exit region of a collision cell.
Figure 3B:
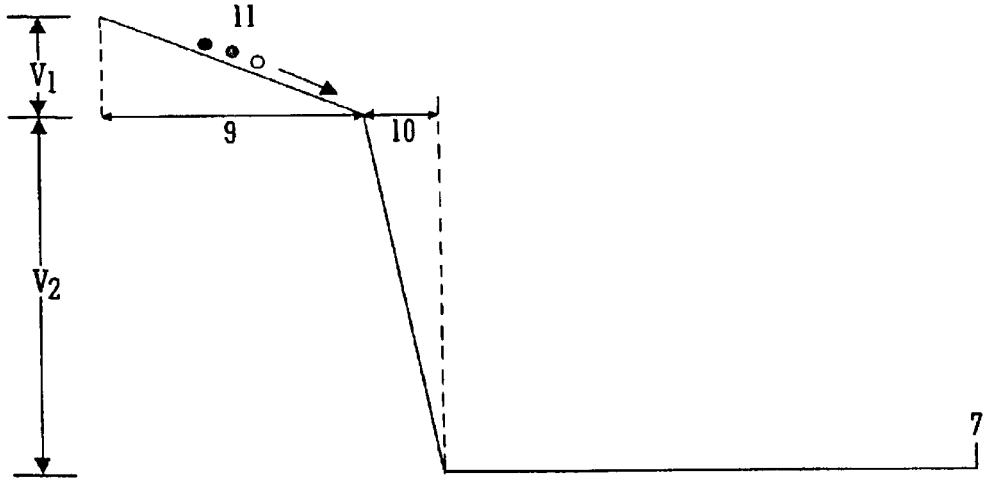
FIG. 3B shows the ions in a first stage axial accelerating field.
Figure 3C:
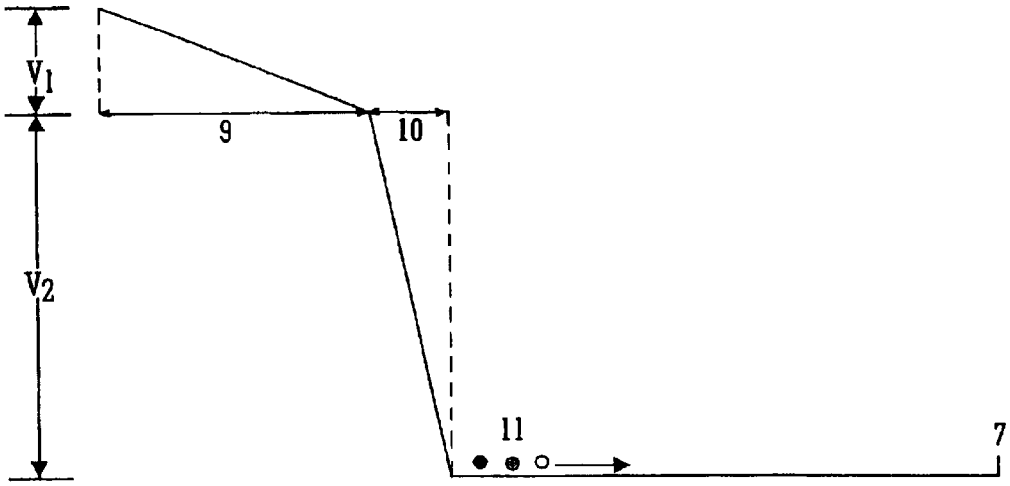
FIG. 3C shows the ions after they have exited the collision cell and have entered a field free time of flight region.
Figure 3D:
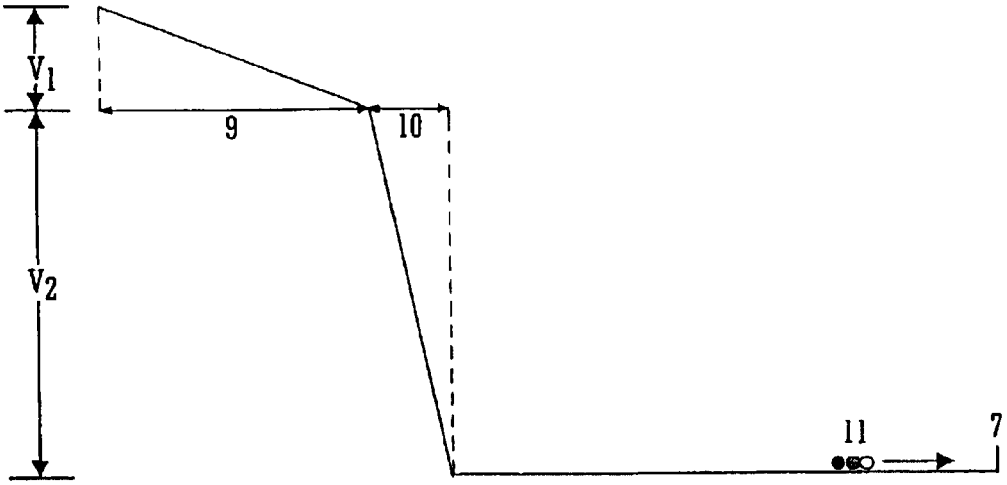
FIG. 3D shows the ions towards the exit of the field free region.

FIG. 3A shows three ions 11 at rest at three different starting positions within the collision cell 5'. In FIG. 3B, a voltage $V_1$ is applied such as to create the first accelerating field. The ions 11 accelerate towards the exit of the collision cell 5' and pass from the first field region 9 to a second field region 10 that is generated by voltage $V_2$. The ions 11 further accelerate in the second field region 10 until they leave the second field region 10 and enter the drift region provided with the preferred quadrupole rod set 6'. The drift region is at a constant DC potential. FIG. 3C shows the three ions 11 just after they have entered the drift region. The three ions are still spatially separated but the ions at the back are travelling relatively faster since they have been accelerated through a greater potential difference. FIG. 3D shows the same three ions 11 as they approach the exit of the time of flight region and the ion detector 7. The faster ions will have nearly caught the slower ions ahead of them. By the time the ions 11 reach the ion detector 7 the faster ions will have just caught up with the slower ions and so all three ions 11 will reach the ion detector 7 at substantially the same time. The use of two axial accelerating electric field regions 9,10 provides a greater degree of freedom in the design of the collision cell 5' and enables second order spatial focussing to be achieved. If two axial accelerating electric fields are used then there are an infinite number of solutions to the conditions required for second order spatial focusing.

Figure 3E:
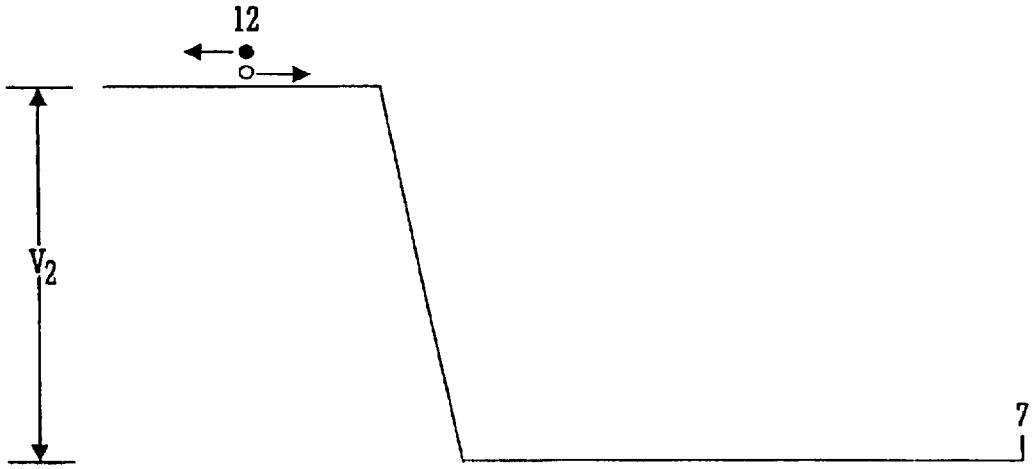
FIG. 3E illustrates ions initially travelling in opposite directions.
Figure 3F:
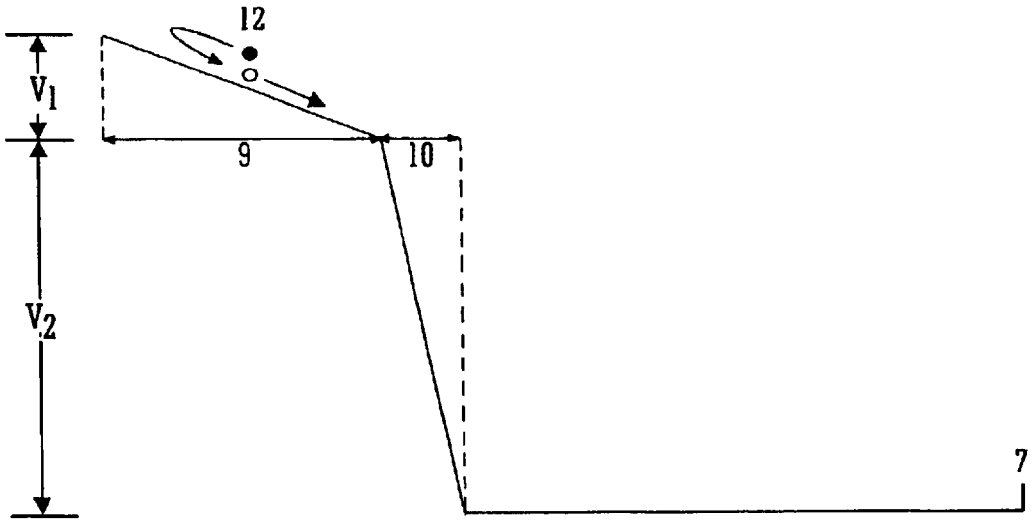
FIG. 3F illustrates ions initially travelling in opposite directions and second order spatial focusing.

Although second order spatial focusing may be achieved there may still be a slight spread in ion arrival times due to a difference in initial ion velocities. This is illustrated in FIGS. 3E and 3F. In FIG. 3E two ions 12 are considered. The two ions 12 have the same starting position immediately prior to the application of the first accelerating electric field but the ions have equal and opposite velocities. One ion is travelling directly towards the exit of the collision cell 5' and the ion detector 7 whilst the other ion is travelling towards the entrance of the collision cell 5'. In FIG. 3F the first accelerating axial electric field has been suddenly applied. The ion moving towards the exit of the collision cell 5' now starts to accelerate towards the ion detector 7. The ion initially moving towards the entrance of the collision cell 5' decelerates until it stops moving and then starts accelerating back towards the exit of the collision cell 5'. By the time this ion gets back to its starting point it now has the same velocity it originally had but now it is moving in the opposite direction, i.e. towards the exit of the collision cell 5'. From this time on it will follow the movement of the first ion exactly but delayed by a turn around time which was necessary for the ion to turn around and return to its starting position. The two ions 12 will arrive at the ion detector 7 at times separated by the turnaround time. The use of two accelerating axial electric fields allows more freedom to minimise the turnaround time whilst still maintaining second order spatial focusing.

In an alternative embodiment ions may be stored and cooled in a separate segmented ring ion trap arranged between the exit of the collision cell 5,5' and the entrance to the preferred multi-mode quadrupole rod set 6,6'. The separate ion trap may be used as an ion guide when the mass spectrometer is used in one mode of operation and may be used to store, cool and accelerate the ions 8 when the mass spectrometer 1 is used in another mode of operation.

Figure 4A:
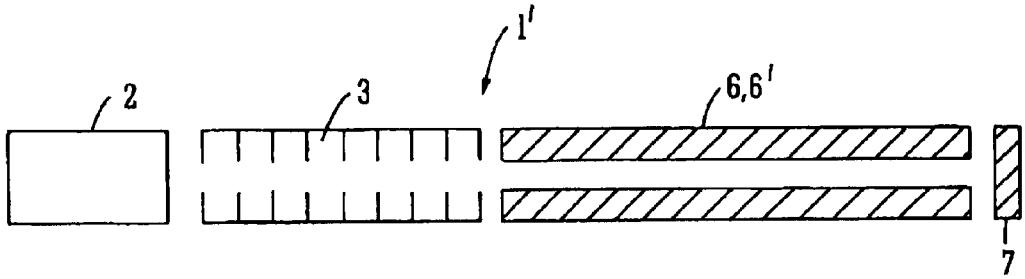
FIG. 4A shows a schematic of a cross section through a mass spectrometer according to a less preferred embodiment.

According to a less preferred embodiment the mass spectrometer 1' may comprise a single multi-mode quadrupole rod set 6,6' functioning as either a mass filter in a first mode of operation or a drift or time of flight region in a second mode of operation. FIG. 4A shows the mass spectrometer 1' according to the less preferred embodiment which comprises an ion source 2, an AC or RF ion guide 3, a multi-mode quadrupole rod set 6,6' and an ion detector 7. The AC or RF ion guide 3 preferably comprises a stacked ring or ion tunnel ion guide. In a first mode of operation ions 8 pass straight through the AC or RF ion guide 3 and are received by the multi-mode quadrupole rod set 6 which is operated in a mass filtering mode so as to selectively transmit parent ions having a desired mass to charge ratio to the ion detector 7. In another mode of operation ions 8 are trapped and stored in the AC or RF ion guide 3 and are ejected or pulsed out of the AC or RF ion guide 3 into the multi-mode quadrupole rod set 6' which is operated in a time of flight mode. A stacked ring ion guide 3 enables the ions 8 to be axially accelerated out of the ion guide 3 for subsequent time of flight mass analysis. In the time of flight mode RF voltages are applied to the rods of the quadrupole rod set 6' and the rods are all maintained at substantially the same DC potential so that the quadrupole rod set 6' acts as a drift or time of flight region of a Time of Flight mass analyser.

Figure 4B:
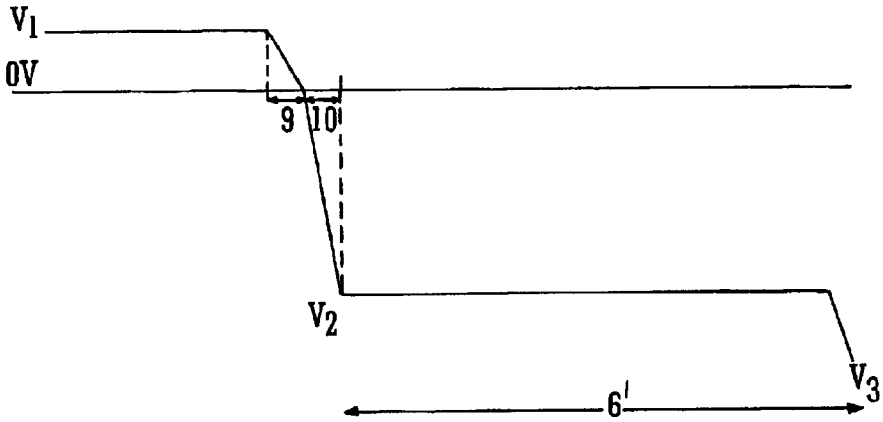
FIG. 4B shows the potential profile at one instance in time along the mass spectrometer when the multi-mode quadrupole rod set is operating in a time of flight mode of operation.

FIG. 4B shows the potential profile along the AC or RF ion guide 3, the multi-mode quadrupole rod set 6' and the region between the exit of the multi-mode quadrupole rod set 6' and the ion detector 7 at one instance in time when the mass spectrometer 1' is operating in a time of flight mode. Ions 8 previously trapped in the AC or RF ion guide 3 by the application of DC potentials to the electrodes of the AC or RF ion guide 3 are preferably accelerated out of the AC or RF ion guide 3 into the multi-mode quadrupole rod set 6' using a two stage axial acceleration field. The last electrode of the AC or RF ion guide 3 is preferably maintained at substantially the same potential $V_2$ as the potential at which the multi-mode quadrupole rod set 6' is held such that substantially no axial electric field is present within the multi-mode quadrupole rod set 6'. Therefore, the multi-mode quadrupole rod set 6' acts as a drift or time of flight region in which the ions 8 separate according to their mass to charge ratios. The ion detector 7 is preferably arranged close to the exit of the multi-mode quadrupole rod set 6' and may be maintained at a potential $V_3$ such that the ions 8 are accelerated out of the exit of the multi-mode quadrupole rod set 6' and into the ion detector 7.

According to further unillustrated embodiments other ion optical devices may be arranged between the exit of the multi-mode quadrupole rod set 6,6' and the ion detector 7. For example, one or more RF collision cells, further multipole rod sets or ion traps may be provided.

According to a yet further unillustrated embodiment a first multi-mode AC or RF ion guide may be provided which according to a first mode of operation may be operated over a wide range of pressures, e.g. up to around 10 mbar. The first AC or RF ion guide may comprise, for example, a multipole rod set or more generally an ion tunnel ion guide. In a second mode of operation the first AC or RF ion guide is maintained at a pressure $<10^{-3}$ mbar and is operated as a time of flight region, e.g. a region wherein ions separate according to their mass to charge ratio. In the first mode of operation ions may be continuously transmitted through the first multi-mode AC or RF ion guide whereas in the second mode of operation ions are preferably pulsed into the first AC or RF ion guide. The first multi-mode AC or RF ion guide is preferably provided upstream of a second AC or RF ion guide. When the first multi-mode AC or RF ion guide is operated in the second mode of operation ions will become temporally dispersed as they pass through the time of flight region. Ions having relatively small mass to charge ratios will reach the exit of the AC or RF ion guide before ions having relatively large mass to charge ratios. According to the preferred embodiment transient or travelling DC voltages are applied to the electrodes of the second AC or RF ion guide so that a plurality of axial trapping regions are created which are then translated along the length of the second AC or RF ion guide from the entrance of the second AC or RF ion guide to the exit of the second AC or RF ion guide. As an axial trapping region is translated along the second AC or RF ion guide a new axial trapping region is preferably created towards or substantially at the entrance of the second AC or RF ion guide. Accordingly, ions transmitted through the multi-mode AC or RF ion guide will effectively be fractionated by the plurality of axial trapping regions being created in and translated along the length of the second AC or RF ion guide. Ions will be received and trapped in the second AC or RF ion guide such that ions having relatively low mass to charge ratios will be held for at least a period of time in axial trapping regions which are relatively close to the exit of the second AC or RF ion guide whereas ions having relatively high mass to charge ratios will be held for at least a period of time in axial trapping regions which are relatively close to the entrance of the second AC or RF ion guide. Preferably, two, three, four, five, six, seven, eight, nine, ten or more than ten axial trapping regions may be provided along the length of the second AC or RF ion guide at any particular point in time and ions exiting the time of flight region may be received in these axial trapping regions.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a multi-mode quadrupole rod set; and an ion detector;

wherein in a first mode of operation said quadrupole rod set acts as a mass filter and wherein in a second mode of operation said quadrupole rod set forms a time of flight region of a Time of Flight mass analyser.

2. A mass spectrometer as claimed in claim 1, wherein in said first mode of operation ions having mass to charge ratios within a first range are transmitted by said quadrupole rod set and ions having mass to charge ratios outside of said first range are substantially attenuated by said quadrupole rod set.

3. A mass spectrometer as claimed in claim 2, wherein in said first mode of operation AC or RF voltages are applied to the rods of said quadrupole rod set and a DC potential difference is maintained between adjacent rods.

4. A mass spectrometer as claimed in claim 1, wherein in said second mode of operation ions are pulsed into said time of flight region.

5. A mass spectrometer as claimed in claim 1, wherein in said second mode of operation ions are transmitted through said quadrupole rod set without being substantially mass filtered and become temporally separated according to their mass to charge ratio, and wherein said ion detector determines the time of flight of said ions through said time of flight region.

6. A mass spectrometer as claimed in claim 5, wherein in said second mode of operation AC or RF voltages are applied to the rods of said quadrupole rod set and all the rods of said quadrupole rod set are maintained at substantially the same DC potential.

7. A mass spectrometer as claimed in claim 1, wherein in said first and/or said second mode of operation said quadrupole rod set is maintained at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

8. A mass spectrometer as claimed in claim 1, wherein in said first and/or said second mode of operation said quadrupole rod set is maintained at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

9. A mass spectrometer as claimed in claim 1, wherein in said first and/or said second mode of operation said quadrupole rod set is maintained at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar;

(xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

10. A mass spectrometer as claimed in claim 1, further comprising:

a collision cell; and a further quadrupole rod set arranged upstream of said collision cell;

wherein said multi-mode quadrupole rod set is arranged downstream of said collision cell.

11. A mass spectrometer as claimed in claim 10, wherein in a MS mode of operation said further quadrupole rod set acts as a mass filter to mass filter parent ions.

12. A mass spectrometer as claimed in claim 10, wherein in a MS mode of operation parent ions are collisionally cooled within said collision cell.

13. A mass spectrometer as claimed in claim 10, wherein in a MS mode of operation parent ions exit said collision cell in a substantially non-pulsed manner.

14. A mass spectrometer as claimed in claim 10, wherein in a MS mode of operation said multi-mode quadrupole rod set is operated in a third mode of operation so as to transmit parent ions without substantially mass filtering said parent ions.

15. A mass spectrometer as claimed in claim 10, wherein in a MS/MS mode of operation said further quadrupole rod set acts as a mass filter to mass filter parent ions.

16. A mass spectrometer as claimed in claim 10, wherein in a MS/MS mode of operation at least 10%, 20%, 30%, 40%, 50%, 60%, 70%, 80%, 90%, 95% or 100% of parent ions entering or within said collision cell are fragmented upon entering or within said collision cell to form fragment ions.

17. A mass spectrometer as claimed in claim 10, wherein in a MS/MS mode of operation fragment ions are collisionally cooled within said collision cell.

18. A mass spectrometer as claimed in claim 10, wherein in a MS/MS mode of operation fragment ions exit said collision cell in a substantially non-pulsed manner.

19. A mass spectrometer as claimed in claim 10, wherein in a MS/MS mode of operation said multi-mode quadrupole rod set is operated in said first mode of operation so as to mass filter fragment ions.

20. A mass spectrometer as claimed in claim 19, wherein said multi-mode quadrupole rod set is scanned so as to act as a mass analyser.

21. A mass spectrometer as claimed in claim 10, wherein in a MS-TOF mode of operation said further quadrupole rod set acts as an ion guide to transmit parent ions without substantially mass filtering said parent ions.

22. A mass spectrometer as claimed in claim 10, wherein in a MS-TOF mode of operation parent ions are collisionally cooled and/or trapped within said collision cell.

23. A mass spectrometer as claimed in claim 10, wherein in a MS-TOF mode of operation parent ions are pulsed out of said collision cell.

24. A mass spectrometer as claimed in claim 10, wherein in a MS-TOF mode of operation said multi-mode quadrupole rod set is operated in said second mode of operation so that parent ions become temporally separated as they pass through the time of flight region formed by said multi-mode quadrupole rod set.

25. A mass spectrometer as claimed in claim 10, wherein in a MS/MS-TOF mode of operation said further quadrupole rod set acts as a mass filter to mass filter parent ions.

26. A mass spectrometer as claimed in claim 10, wherein in a MS/MS-TOF mode of operation at least 10%, 20%, 30%, 40%, 50%, 60%, 70%, 80%, 90%, 95% or 100% of parent ions entering or within said collision cell are fragmented upon entering or within said collision cell to form fragment ions.

27. A mass spectrometer as claimed in claim 10, wherein in a MS/MS-TOF mode of operation fragment ions are collisionally cooled and/or trapped within said collision cell.

28. A mass spectrometer as claimed in claim 10, wherein in a MS/MS-TOF mode of operation fragment ions are pulsed out of said collision cell.

29. A mass spectrometer as claimed in claim 10, wherein in a MS/MS-TOF mode of operation said multi-mode quadrupole rod set is operated in said second mode of operation so that fragment ions become temporally separated as they pass through the time of flight region formed by said multi-mode quadrupole rod set.

30. A mass spectrometer as claimed in claim 10, wherein said collision cell comprises a segmented rod set.

31. A mass spectrometer as claimed in claim 10, wherein said collision cell comprises a stacked ring set comprising a plurality of electrodes having apertures wherein ions are transmitted, in use, through said apertures.

32. A mass spectrometer as claimed in claim 10, wherein an axial DC voltage gradient is maintained in use along at least a portion of the length of said collision cell.

33. A mass spectrometer as claimed in claim 32, wherein in a mode of operation an axial DC voltage difference is maintained, in use, along at least a first portion of said collision cell and is selected from the group consisting of: (i) 0.1–50 V; (ii) 50–100 V; (iii) 100–200 V; (iv) 200–500 V; (v) 500–1000 V; (vi) 1000–2000 V; (vii) 2000–3000 V; (viii) 3000–4000 V; (ix) 4000–5000 V; (x) 5000–6000 V; (xi) 6000–7000 V; (xii) 7000–8000 V; (xiii) 8000–9000 V; (xiv) 9000–10000 V; and (xv) >10 kV.

34. A mass spectrometer as claimed in claim 32, wherein in a mode of operation an axial DC voltage gradient is maintained, in use, along at least a first portion of said collision cell selected from the group consisting of: (i) 0.1–5 V/mm; (ii) 5–10 V/mm; (iii) 10–20 V/mm; (iv) 20–30 V/mm; (v) 30–40 V/mm; (vi) 40–50 V/mm; (vii) 50–60 V/mm; (viii) 60–70 V/mm; (ix) 70–80 V/mm; (x) 80–90 V/mm; (xi) 90–100 V/mm; (xii) 100–150 V/mm; (xiii) 150–200 V/mm; (xiv) 200–250 V/mm; (xv) 250–300 V/mm; (xvi) 300–350 V/mm; (xvii) 350–400 V/mm; (xviii) 400–450 V/mm; (xix) 450–500 V/mm; and (xx) >500 V/mm.

35. A mass spectrometer as claimed in claim 33, wherein said first portion is located within a region located 0–10%, 10–20%, 20–30%, 30–40%, 40–50%, 50–60%, 60–70%, 70–80%, 80–90%, or 90–100% of the length of said collision cell measured from an ion entrance of said collision cell to an ion exit of said collision cell.

36. A mass spectrometer as claimed in claim 33, wherein said first portion is located in the rearmost 10%, 20%, 30%, 40% or 50% of said collision cell.

37. A mass spectrometer as claimed in claim 10, wherein said collision cell consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; and (xv) >150 electrodes.

38. A mass spectrometer as claimed in claim 10, wherein said collision cell is maintained, in use, at a pressure selected from the group consisting of: (i) $>1.0\times10^{-3}$ mbar; (ii) $>5.0\times10^{-3}$ mbar; (iii) $>1.0\times10^{-2}$ mbar; (iv) $10^{-3}$–$10^{-2}$ mbar; and (v) $10^{-4}$–$10^{-1}$ mbar.

39. A mass spectrometer as claimed in claim 10, wherein in a mode of operation ions are trapped but are not substantially fragmented within said collision cell.

40. A mass spectrometer as claimed in claim 10, wherein in a mode of operation ions are trapped and are substantially fragmented within said collision cell.

41. A mass spectrometer as claimed in claim 10, wherein in a mode of operation ions are trapped within said collision cell and are progressively moved towards an exit of said collision cell.

42. A mass spectrometer as claimed in claim 10, wherein in a mode of operation ions are stored or trapped within said collision cell near the exit of said collision cell.

43. A mass spectrometer as claimed in claim 10, wherein in a mode of operation ions are collisionally cooled within said collision cell in an ion trapping region located near the exit of said collision cell.

44. A mass spectrometer as claimed in claim 10, wherein in a mode of operation electrodes forming said collision cell are maintained at different DC potentials so that at least a first and a second different stage axial acceleration electric field regions are provided to accelerate ions out of said collision cell.

45. A mass spectrometer as claimed in claim 44, wherein in use prior to accelerating ions out of said collision cell the pressure within said collision cell is reduced.

46. A mass spectrometer as claimed in claim 44, wherein the ratio of the axial electric field strength in said second stage axial acceleration electric field region to the axial electric field strength in said first stage axial acceleration electric field region is selected from the group consisting of: (i) ≧2; (ii) ≧3; (iii) ≧4; (iv) ≧5; (v) ≧6; (vi) ≧7; (vii) ≧8; (viii) ≧9; and (ix) ≧10.

47. A mass spectrometer as claimed in claim 44, wherein said collision cell further comprises one or more grid electrodes arranged between electrodes forming said collision cell, wherein one or more DC voltages are applied to said one or more grid electrodes in order to provide said first and/or said second stage axial acceleration electric field region.

48. A mass spectrometer as claimed in claim 10, wherein in use one or more transient DC voltages or one or more transient DC voltage waveforms are initially provided at a first axial position and are then subsequently provided at second, then third different axial positions along said collision cell.

49. A mass spectrometer as claimed in claim 10, wherein one or more transient DC voltages or one or more transient DC voltage waveforms move in use from one end of said collision cell to another end of said collision cell so that ions are urged along said collision cell.

50. A mass spectrometer as claimed in claim 48, wherein said one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

51. A mass spectrometer as claimed in claim 48, wherein said one or more transient DC voltage waveforms comprise a repeating waveform.

52. A mass spectrometer as claimed in claim 51, wherein said one or more transient DC voltage waveforms comprise a square wave.

53. A mass spectrometer as claimed in claim 10, wherein said collision cell comprises a quadrupole rod set.

54. A mass spectrometer as claimed in claim 10, further comprising an AC or RF ion guide arranged upstream of said further quadrupole rod set, said AC or RF ion guide comprising a plurality of electrodes.

55. A mass spectrometer as claimed in claim 1, further comprising an AC or RF ion guide arranged upstream of said multi-mode quadrupole rod set, said AC or RF ion guide comprising a plurality of electrodes.

56. A mass spectrometer as claimed in claim 54, wherein said AC or RF ion guide comprises a quadrupole, hexapole, octapole or higher order multipole rod set.

57. A mass spectrometer as claimed in claim 54, wherein said AC or RF ion guide comprises a segmented rod set.

58. A mass spectrometer as claimed in claim 54, wherein said AC or RF ion guide comprise an ion tunnel ion guide comprising a plurality of electrodes having apertures through which ions are transmitted.

59. A mass spectrometer as claimed in claim 54, wherein said AC or RF ion guide is supplied with an AC or RF voltage having a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

60. A mass spectrometer as claimed in claim 54, wherein said AC or RF ion guide is supplied with an AC or RF voltage having an amplitude selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

61. A mass spectrometer as claimed in claim 54, wherein in a mode of operation parent ions are arranged to be trapped, stored or accumulated in said AC or RF ion guide whilst other ions are being collisionally cooled and/or fragmented in said collision cell and/or whilst ions are being transmitted through said multi-mode quadrupole ion trap operating in said second mode of operation.

62. A mass spectrometer as claimed in claim 54, wherein in a mode of operation ions are pulsed out of said AC or RF ion guide.

63. A mass spectrometer as claimed in claim 54, wherein one or more transient DC potentials or one or more DC potential waveforms are applied to said electrodes of said AC or RF ion guide.

64. A mass spectrometer as claimed in claim 63, wherein said one or more transient DC potentials or said one or more DC potential waveforms urge ions from one region of said AC or RF ion guide to another region of said AC or RF ion guide.

65. A mass spectrometer as claimed in claim 10, wherein an ion trap is arranged between said collision cell and said multi-mode quadrupole rod set.

66. A mass spectrometer as claimed in claim 1, further comprising a further drift or time of flight region arranged downstream of said multi-mode quadrupole rod set.

67. A mass spectrometer as claimed in claim 1, further comprising a reflectron arranged downstream of said multi-mode quadrupole rod set.

68. A method of mass spectrometry comprising:

providing a multi-mode quadrupole rod set and an ion detector;

operating said quadrupole rod set in a first mode of operation wherein said quadrupole rod set acts as a mass filter; and operating said quadrupole rod set in a second mode of operation wherein said quadrupole rod set forms a time of flight region of a Time of Flight mass analyser.

69. A mass spectrometer comprising:

a first multi-mode AC or RF ion guide wherein in a first mode of operation said first AC or RF ion guide acts as an ion guide and wherein in a second mode of operation said first AC or RF ion guide forms a time of flight region.

70. A mass spectrometer as claimed in claim 69, wherein in said first mode of operation ions are transmitted through said first AC or RF ion guide without being substantially mass filtered.

71. A mass spectrometer as claimed in claim 69, wherein in said first mode of operation ions are not substantially fragmented within said first AC or RF ion guide.

72. A mass spectrometer as claimed in claim 69, wherein in said first mode of operation ions are substantially continuously transmitted through said first AC or RF ion guide.

73. A mass spectrometer as claimed in claim 69, wherein in said second mode of operation ions are pulsed into said time of flight region.

74. A mass spectrometer as claimed in claim 69, wherein in said second mode of operation ions are transmitted through said first AC or RF ion guide without being substantially mass filtered and become temporally separated according to their mass to charge ratio.

75. A mass spectrometer as claimed in claim 74, further comprising an ion detector and wherein said ion detector determines the time of flight of said ions through said time of flight region.

76. A mass spectrometer as claimed in claim 69, further comprising a second AC or RF ion guide, wherein ions transmitted through said first multi-mode AC or RF ion guide are received by said second AC or RF ion guide.

77. A mass spectrometer as claimed in claim 76, wherein said second AC or RF ion guide comprises a segmented rod set.

78. A mass spectrometer as claimed in claim 76, wherein said second AC or RF ion guide comprise an ion tunnel ion guide comprising a plurality of electrodes having apertures through which ions are transmitted in use.

79. A mass spectrometer as claimed in claim 76, wherein in use one or more transient DC voltages or one or more transient DC voltage waveforms are initially provided at a first axial position and are then subsequently provided at second, then third different axial positions along said second AC or RF ion guide.

80. A mass spectrometer as claimed in claim 76, wherein one or more transient DC voltages or one or more transient DC voltage waveforms move in use from one end of said second AC or RF ion guide to another end of said second AC or RF ion guide so that ions are urged along said second AC or RF ion guide.

81. A mass spectrometer as claimed in claim 79, wherein said one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

82. A mass spectrometer as claimed in claim 79, wherein said one or more transient DC voltage waveforms comprise a repeating waveform.

83. A mass spectrometer as claimed in claim 82, wherein said one or more transient DC voltage waveforms comprise a square wave.

84. A mass spectrometer as claimed in claim 79, wherein when said first multi-mode AC or RF ion guide is operated in said second mode of operation ions having mass to charge ratios within a first range are trapped in a first axial trapping region within said second AC or RF ion guide and ions having mass to charge ratios within a second different range are trapped in a second different axial trapping region within said second AC or RF ion guide.

85. A mass spectrometer as claimed in claim 84, wherein when said first multi-mode AC or RF ion guide is operated in said second mode of operation ions having mass to charge ratios within a third different range are trapped in a third axial trapping region within said second AC or RF ion guide and ions having mass to charge ratios within a fourth different range are trapped in a fourth different axial trapping region within said second AC or RF ion guide.

86. A mass spectrometer as claimed in claim 85, wherein when said first multi-mode AC or RF ion guide is operated in said second mode of operation ions having mass to charge ratios within a fifth range are trapped in a fifth axial trapping region within said second AC or RF ion guide and ions having mass to charge ratios within a sixth different range are trapped in a sixth different axial trapping region within said second AC or RF ion guide.

87. A mass spectrometer as claimed in claim 69, wherein in said first and/or second mode of operation said first AC or RF ion guide is maintained at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

88. A mass spectrometer as claimed in claim 69, wherein in said first and/or second mode of operation said first AC or RF ion guide is maintained at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

89. A mass spectrometer as claimed in claim 69, wherein in said first and/or second mode of operation said first AC or RF ion guide is maintained at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-6}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

90. A mass spectrometer as claimed in claim 69, wherein in said first mode of operation said first AC or RF ion guide is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v)

greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

91. A mass spectrometer as claimed in claim 69, wherein in said first mode of operation said first AC or RF ion guide is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

92. A mass spectrometer as claimed in claim 69, wherein in said first mode of operation said first AC or RF ion guide is maintained at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

93. A mass spectrometer as claimed in claim 69, wherein said first multi-mode AC or RF ion guide comprises a quadrupole, hexapole, octapole or higher order multipole rod set.

94. A mass spectrometer as claimed in claim 69, wherein said first multi-mode AC or RF ion guide comprises a segmented rod set.

95. A mass spectrometer as claimed in claim 69, wherein said first multi-mode AC or RF ion guide comprise an ion tunnel ion guide comprising a plurality of electrodes having apertures through which ions are transmitted in use.

96. A mass spectrometer as claimed in claim 69, wherein in said first mode of operation said first AC or RF ion guide is supplied with an AC or RF voltage having a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

97. A mass spectrometer as claimed in claim 69, wherein in said second mode of operation said first AC or RF ion guide is supplied with an AC or RF voltage having a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

98. A mass spectrometer as claimed in claim 69, wherein in said first mode of operation said first AC or RF ion guide is supplied with an AC or RF voltage having an amplitude selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

99. A mass spectrometer as claimed in claim 69, wherein in said second mode of operation said first AC or RF ion guide is supplied with an AC or RF voltage having an amplitude selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 400–450V peak to peak; (x) 450–500V peak to peak; and (xi) >500V peak to peak.

100. A mass spectrometer as claimed in claim 69, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Matrix Assisted Laser Desorption Ionisation ("MALDI") ion source; (v) a Laser Desorption Ionisation ("LDI") ion source; (vi) an Inductively Coupled Plasma ("ICP") ion source; (vii) an Electron Impact ("EI") ion source; (viii) a Chemical Ionisation ("CI") ion source; (ix) a Fast Atom Bombardment ("FAB") ion source; and (x) a Liquid Secondary Ions Mass Spectrometry ("LSIMS") ion source.

101. A mass spectrometer as claimed in claim 69, further comprising a pulsed ion source.

102. A mass spectrometer as claimed in claim 69, further comprising a continuous ion source.

103. A method of mass spectrometry comprising:

providing a multi-mode AC or RF ion guide;

operating said AC or RF ion guide in a first mode of operation wherein said AC or RF ion guide acts as an ion guide; and operating said AC or RF ion guide in a second mode of operation wherein said AC or RF ion guide forms a time of flight region.

* * * * *